US008458940B2

(12) United States Patent
Davidson et al.

(10) Patent No.: US 8,458,940 B2
(45) Date of Patent: Jun. 11, 2013

(54) GARMENT TAG

(75) Inventors: Tyrone Dupree Davidson, Brooklyn, NY (US); Youngju Kim Hampton, Croton on Hudson, NY (US)

(73) Assignee: PVH Corp., New York, NY (US)

( * ) Notice: Subject to any disclaimer, the term of this patent is extended or adjusted under 35 U.S.C. 154(b) by 50 days.

(21) Appl. No.: 12/512,139

(22) Filed: Jul. 30, 2009

(65) Prior Publication Data

US 2011/0023342 A1 Feb. 3, 2011

(51) Int. Cl.
*G09F 3/10* (2006.01)

(52) U.S. Cl.
USPC ..... 40/638; 2/145; 229/74; 40/315; 40/672

(58) Field of Classification Search
USPC ..... 40/638, 672, 299.01, 636, 661.04, 40/662, 642.02
See application file for complete search history.

(56) References Cited

U.S. PATENT DOCUMENTS

| | | | | |
|---|---|---|---|---|
| 1,011,869 | A | 12/1911 | Smith | 40/315 |
| 1,057,362 | A | 3/1913 | Smith | 40/315 |
| 1,146,254 | A | 7/1915 | Hirner | 40/315 |
| 1,568,060 | A | 1/1926 | Craig | |
| 1,620,874 | A | 3/1927 | Craig | 40/315 |
| 1,872,260 | A | 8/1932 | Elzey | 223/83 |
| 2,099,029 | A | 11/1937 | McKay | 229/74 |
| 2,146,052 | A | 2/1939 | Blumenstock | |
| 2,197,138 | A | 4/1940 | Turet | 40/315 |
| 2,538,927 | A | 1/1951 | Truitt | 40/315 |
| 2,610,419 | A | 9/1952 | Baumbach | 40/315 |
| 2,739,399 | A | 3/1956 | Henson | 40/662 |
| 2,756,525 | A | 7/1956 | Greenberger | 40/315 |
| 4,539,767 | A | 9/1985 | Jaffe | 40/316 |
| 5,018,286 | A | 5/1991 | Zahner | |
| 5,343,648 | A | 9/1994 | Bracken | 40/638 |
| 5,561,932 | A * | 10/1996 | Bracken | 40/638 |

(Continued)

FOREIGN PATENT DOCUMENTS

| | | |
|---|---|---|
| CH | 306 813 | 4/1955 |

OTHER PUBLICATIONS

PCT International Search Report in corresponding International Application No. PCT/US2010/043961, dated Sep. 22, 2010.

(Continued)

*Primary Examiner* — Joanne Silbermann
*Assistant Examiner* — Shin Kim
(74) *Attorney, Agent, or Firm* — Fitzpatrick, Cella, Harper & Scinto

(57) ABSTRACT

A garment tag is provided that includes a band having a first opening for attaching to a first fastener of a garment and a second opening for attaching to a second fastener of the garment, the band having a first display portion that displays printed information regarding the garment at a fold in the garment when the garment is in a folded state. The first and second fasteners may be buttons and the first and second openings may be slots. The first display portion may be defined by two creases in the band, the creases being spaced apart by the approximate width of the garment fold. The band may also be pre-folded at the creases.

53 Claims, 6 Drawing Sheets

U.S. PATENT DOCUMENTS

| | | | | |
|---|---|---|---|---|
| 5,645,300 | A | 7/1997 | Hill | 283/81 |
| 5,704,649 | A | 1/1998 | Small | 283/81 |
| 5,947,366 | A | 9/1999 | Feldmann et al. | 229/87.17 |
| 6,142,531 | A | 11/2000 | Harris, II | 283/74 |
| 6,915,601 | B2 | 7/2005 | Davis et al. | 40/299.01 |
| 7,003,910 | B2 | 2/2006 | Sharp | 40/673 |
| 7,257,916 | B2 * | 8/2007 | Hall et al. | 40/672 |
| D589,396 | S | 3/2009 | Kim | D11/228 |
| 2005/0102876 | A1 | 5/2005 | Kelly | 40/661.04 |
| 2007/0273520 | A1 | 11/2007 | Chamandy | |
| 2009/0135014 | A1 | 5/2009 | Bleckmann et al. | |

OTHER PUBLICATIONS

Written Opinion of the International Searching Authority in corresponding International Application No. PCT/US2010/043961, dated Sep. 22, 2010.

International Preliminary Report on Patentability dated Nov. 3, 2011 in PCT/US10/43961. 40 sheets.

International Preliminary Report on Patentability dated Jul. 27, 2011 in PCT/US10/43961. 13 sheets.

* cited by examiner

GARMENT TAG

BACKGROUND OF THE INVENTION

Field of the Invention

The invention is related, in general, to a garment tag, and in particular to a garment tag to display information about the garment, and more specifically to a readily visible garment tag for attachment to a folded garment arranged for sale in a stack of like folded and labeled garments.

Labels and hangtags are well known for the general purpose of identifying various features of garments. However, such labels and hangtags are commonly affixed to the garment in such a manner and location that the information appearing thereon, and even the label or hangtag itself, is usually hidden when the garments are folded and stacked for storage or display. Many types of garments, including shirts, are displayed in stacks of like garments on retail shelves and displays.

In the case of shirts, information about the shirt is commonly displayed on a tag sewn onto the inside of the shirt near the collar and on a hangtag. Moreover, when shopping for such shirts, consumers are often presented with a stack of folded shirts, with the collar and front of each shirt facing up with the collar being farthest away from the eye of the consumer. Such stacks are often placed on a shelf, table, rack, or in a cube-type merchandising display arrangement. Alternatively, the shirts, for example, may be stacked as pairs of folded shirts, where a shirt is stacked on top of another shirt such that the collar of one shirt is opposite from the collar of an adjoining shirt.

By virtue of such stacked configurations, the aforementioned collar tag and/or hangtag are often hidden. As a result, a consumer searching for a particular size of shirt, from among the stack of folded shirts, for example, would have to lift one or more shirts up from the stack in order to access a particular shirt to view the sizing information on the collar tag or hang tag. For example, in searching for a particular size of shirt in the stack, the consumer may spend considerable time and effort removing shirts from a stack, while also inadvertently disturbing the stack, thereby making searching more difficult for other consumers, and requiring the merchant to expend resources to frequently monitor, straighten, and reorganize the stack of shirts.

SUMMARY OF THE INVENTION

It is desirable to have a garment tag which will permit a manufacturer or retailer to store and/or display a stack of a plurality of folded garments while maintaining the visibility and legibility of certain garment information appearing on a portion of the garment tag which remains visible at least while the garments are stacked. A garment tag is provided that includes a band having a first opening for attaching to a first fastener of a garment and a second opening for attaching to a second fastener of the garment, the band having a first display portion that displays printed information regarding the garment at a fold in the garment when the garment is in a folded state. The first and second fasteners may be buttons and the first and second openings may be slots. The first display portion may be defined by two creases in the band, the creases being spaced apart by the approximate width of the garment fold. The band may also be pre-folded at the creases.

The garment tag can be made of at least one of paper, paperboard, cardboard, plastic, woven fabric, ribbon, and card stock.

The band may also be configured to be formed substantially in a circular shape, wherein a portion of the band between the fold and the first fastener is substantially semicircular, and another portion of the band between the fold and the second fastener is substantially semicircular. The printed information may display information related to at least one of a: scanning bar code, garment size, brand identifier, manufacturer, garment item number, garment care information, recycling symbol, garment identifier, garment color, garment fit type, and garment style. The garment tag may further include a radio-frequency identification (RFID) chip.

The band openings may be configured to be attached to the fasteners when the garment is in an unfolded state, and wherein the garment is subsequently folded. Moreover, the band openings may be configured to be attached to the fasteners subsequent to the garment being folded. The band also may have a second display portion located between the first opening and the first display portion, and may also have a third display portion located between the second opening and the first display portion.

The first and second openings may be positioned proximate to a longitudinal centerline of the band extending through the first, second, and third display portions. The first and second openings may be positioned at proximal and distal ends of the band. The first and second openings may be slots configured to extend in at least one of the following directions: substantially parallel to the longitudinal centerline, and substantially perpendicular to the longitudinal centerline. The first display portion is positioned approximately midway between the proximal and distal ends of the band.

In another aspect of the invention, a garment tag is provided that includes a band having a first fastener for attaching into a first opening of a garment and a second fastener for attaching into a second opening of the garment, the band having a portion that displays printed information regarding the garment at a fold in the garment when the garment is in a folded state.

In another aspect of the invention, a garment tag is provided that includes a band having a first adhesive area for attaching to a first area of a garment and a second adhesive area for attaching to a second area of the garment, the band having a portion that displays printed information regarding the garment at a fold in the garment when the garment is in a folded state. The first adhesive area and the second adhesive area may include at least one of a permanent adhesive and a non-permanent adhesive. The first adhesive area and the second adhesive area may also include a removable backing that can be removed to expose the adhesive.

In another aspect of the invention, a tagged garment is provided that includes a garment having a first fastener and a second fastener; and a band having a first opening attached to the first fastener of the garment and a second opening attached to the second fastener of the garment. The band has a first display portion that displays printed information regarding the garment at a fold in the garment when the garment is in a folded state.

In yet another aspect of the invention a plurality of tagged garments arranged in a stack is provided. Each garment in the stack has a first fastener and a second fastener, and a band having a first opening attached to the first fastener of the garment and a second opening attached to the second fastener of the garment. The band has a first display portion that displays printed information regarding the garment at a fold in the garment when the garment is in a folded state.

In another aspect of the invention a method of making a garment tag is provided. The method includes the steps of making a band, forming a first opening at a proximal end of the band, forming a second opening at a distal end of the band, creating two creases in the band, the creases spaced apart by the approximate width of a garment when the garment is in a folded state, and applying printed information to a display portion of the band, the display portion of the band located between the two creases.

In another aspect of the invention, a method of applying a garment tag to a garment is provided, the garment tag comprising a band having first and second openings respectively positioned at proximal and distal ends of the band. The band further has a first display portion that displays printed information regarding the garment at a fold in the garment when the garment is in a folded state. The method includes the steps of attaching the first opening to a first fastener of the garment and attaching the second opening to a second fastener of the garment. The method may further include the step of folding the garment so that the display portion of the garment tag folds over the fold in the garment. The method may also further include the step of folding the garment so that the display portion of the garment tag covers at least a portion of the fold in the garment.

Moreover, the method may further include the step of stacking two or more folded garments, each garment having a garment tag applied thereto.

DETAILED DESCRIPTION

Figure 1:
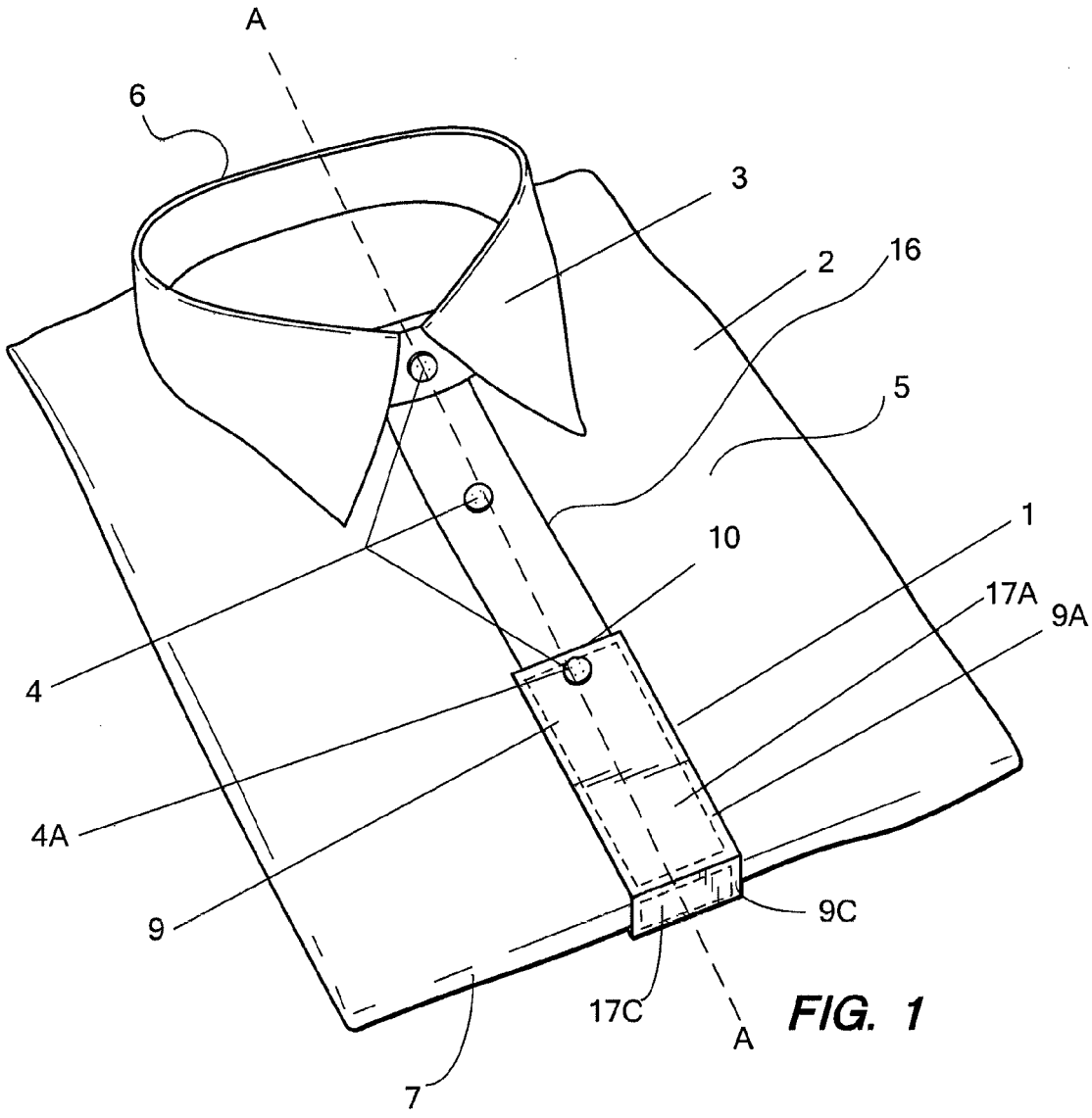
FIG. 1 shows an embodiment of a garment tag attached to a folded garment, in accordance with an embodiment of the invention, viewed from a front and right side of the folded garment.

FIG. 1 shows an embodiment of the garment tag 1 attached to a folded garment 2, which is shown, for example, as a folded shirt 2, and more preferably, a folded shirt 2 with a collar 3, fastened with buttons 4 down the front that close a vertical opening between the left and right sides of the shirt 2. The combination of the garment tag 1 and the folded garment 2 comprise a labeled shirt, which can be manufactured, packaged, and sold together. The garment tag 1 is attached to buttons 4A and 4B of the folded shirt 2 and extends around and covers a portion of a bottom side 7 of the folded shirt 2.

Figure 2:
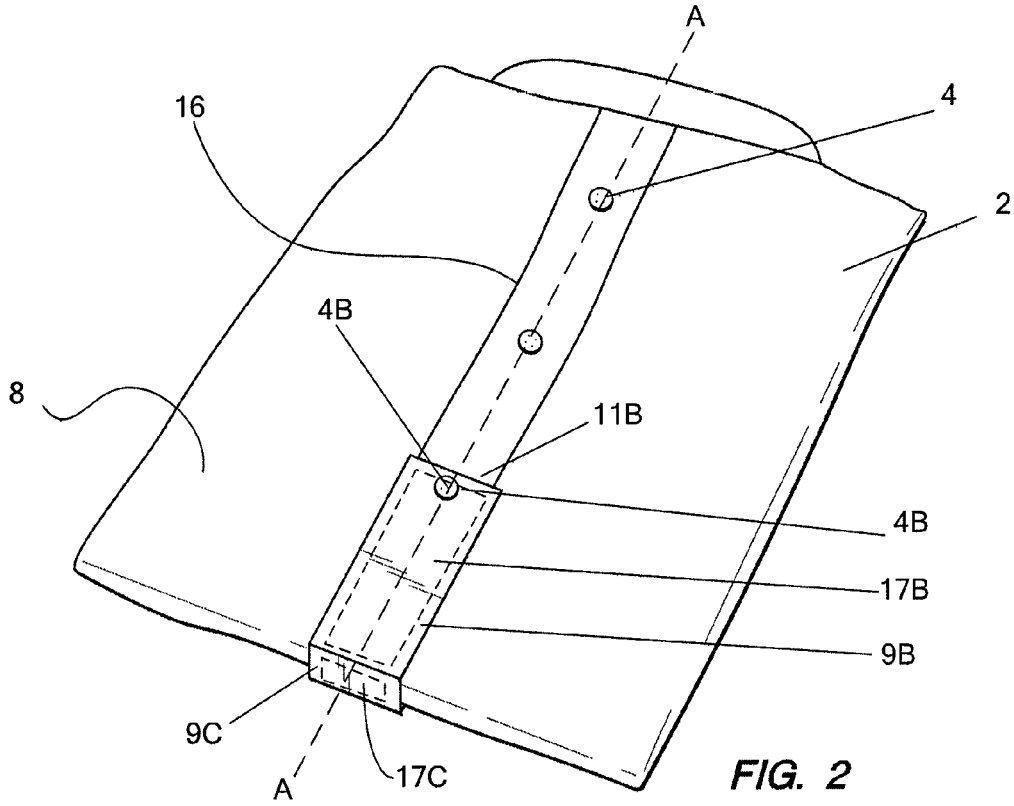
FIG. 2 shows the garment tag shown in FIG. 1, viewed from a rear and right side of the folded garment.

The shirt 2 is folded, such as for retail display, with the collar 3 appearing on a front side 5 and top side 6 of the folded shirt 2. A series of spaced and longitudinally aligned buttons 4 are attached to the shirt 2 and extend downwardly from the collar 3 toward and around the bottom side 7 and up a rear side 8 of the folded shirt 2 (FIG. 2). The buttons 4 on the front side 5 and rear side 8 of the folded shirt 2 are longitudinally aligned with longitudinal axis A-A. The longitudinally aligned buttons 4 on the front side 5 and rear side 8 of the folded shirt 2 correspond to the buttons 4 on the front of the shirt 2 when unfolded (FIG. 6), which are used to close a vertical opening at the front of the shirt 2. The buttons 4 described herein can be attached to the fabric of the shirt 2 with a button shank (not shown), which may include a metal shank, plastic shank, a threaded shank, and like connections. As used herein, a button shank also includes threaded connections between a button and the folded shirt 2.

The garment tag 1 is comprised of a band 9 that is configured to attach to at least first and second buttons 4A and 4B, respectively, of the folded shirt 2. As shown in the embodiment in FIGS. 1 and 2, the band 9 is an elongate member having a uniform width W and is aligned above and parallel to axis A-A and the buttons 4 of the folded shirt 2. The band 9 may be formed from at least one of paper, paper board, cardboard, plastic, woven fabric, card stock, or other suitable material, and can be formed by conventional punching, cutting, splicing, and joining methods. The band 9 is preferably configured to attach to at least a first button 4A on the front side 5 of the folded shirt 2 and a second button 4B on the rear side 8 of the folded shirt 2, while also extending around the bottom 7 side (i.e., third side) of the folded shirt 2.

The band 9 shown in FIGS. 1-4 includes a plurality of planar portions 9A, 9B, and 9C. In this embodiment, a first longitudinally extending planar portion 9A extends along the first side 5 of the folded shirt 2, the first portion 9A having a first end 10, and the first attachment means being located proximate to the first end 10. For example, a first slot 14 (FIG. 3) formed near the first end 10 can be used to attach the first end 10 to the first button 4A.

The band 9 also includes a second longitudinally extending planar portion 9B extending at least from a second end 11 of the band 9 along the second side 8 of the folded shirt 2, the second attachment means being located proximate to the second end 11. For example, a second slot 15 (FIG. 3) formed in the second end 11 can be used to attach the second end 11 to the second button 4B of the folded shirt 2.

As shown in FIGS. 1 and 2, the band 9 is folded such that its first portion 9A extends over the front side 5 of the folded shirt 2 at least from the first end 10 of the band 9 towards the bottom side 7 of the folded shirt 2 and the second longitudinally extending portion 9B extends over the rear side 8 of the folded shirt 2 from the second end 11 of the band 9 towards the bottom side 7 of the folded shirt 2. As shown in FIGS. 1 and 2, the band 9 includes a third longitudinally extending planar portion 9C extending along the bottom side 7 of the folded garment 2 between the first 9A and second portions 9B.

The length of the first, second, and third portions, 9A-9C, of the band 9 may be different from each other. As shown in FIGS. 1 and 2, the angles between the first and third portions, 9A and 9C, respectively, and between the second and third portions, 9B, and 9C, respectively, are about ninety degrees, substantially forming the garment tag 1 with a u-shaped cross section. Of course, as would be appreciated by one of ordinary skill in the art, other angles between the first, second, and third portions are possible.

Figure 3:
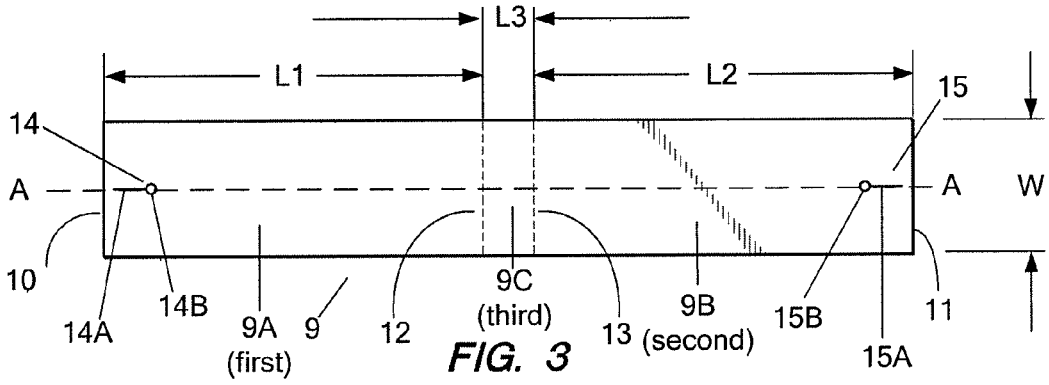
FIG. 3 shows a plan view of the garment tag shown in FIGS. 1 and 2 as an unfolded blank.

FIG. 3 shows the embodiment of the garment tag 1 shown in FIGS. 1 and 2 in an unfolded condition. In a preferred embodiment the band 9 has a substantially uniform width W in the longitudinal direction, which is preferably about the same as the width of the placket 16 of the folded shirt 2. The dotted lines 12 and 13, which may or may not appear on a surface of the band 9, delineate the first, second, and third portions, 9A-9C, respectively, of the band 9. The length L3 of the third portion 9C is preferably about equal to the dimension of the bottom side 7 (i.e., third side) of the folded shirt 2. Moreover, the length L1 of the first portion 9A and the length L2 of the second portion 9B are suitably configured to permit the attachment of the first and second attachment means to the first button 4A and the second button 4B, respectively, while disposing the third portion 9C at least covering a portion of the bottom side 7 of the folded shirt 2.

The formed garment tag 1, shown in FIGS. 1 and 2 has an inner side configured to face the surface of the garment the garment tag 1 is attached to. Moreover, the garment tag 1 has an outer side, which can include information displayed thereon. As shown in the embodiment of the garment tag 1 shown in FIGS. 1 and 2, the information can be printed in at least one of callout regions 17A, 17B, and 17C of the band 9 corresponding to respective portions 9A, 9B, and 9C. Preferably, printed matter is printed at least in callout region 17C of portion 9C. Of course, the inner side may also include information displayed thereon. Such information displayed in the callout regions can include information about the garment, and more specifically, can include at least one of garment size, garment fit type (e.g., slim fit, regular fit, loose fit), brand identifier, manufacturer, garment item number, garment care information, recycling symbol, recycling number, garment color, garment feature type (e.g., oxford collar, pinpoint collar, French cuff), garment fabric type, and garment style.

Figure 5:
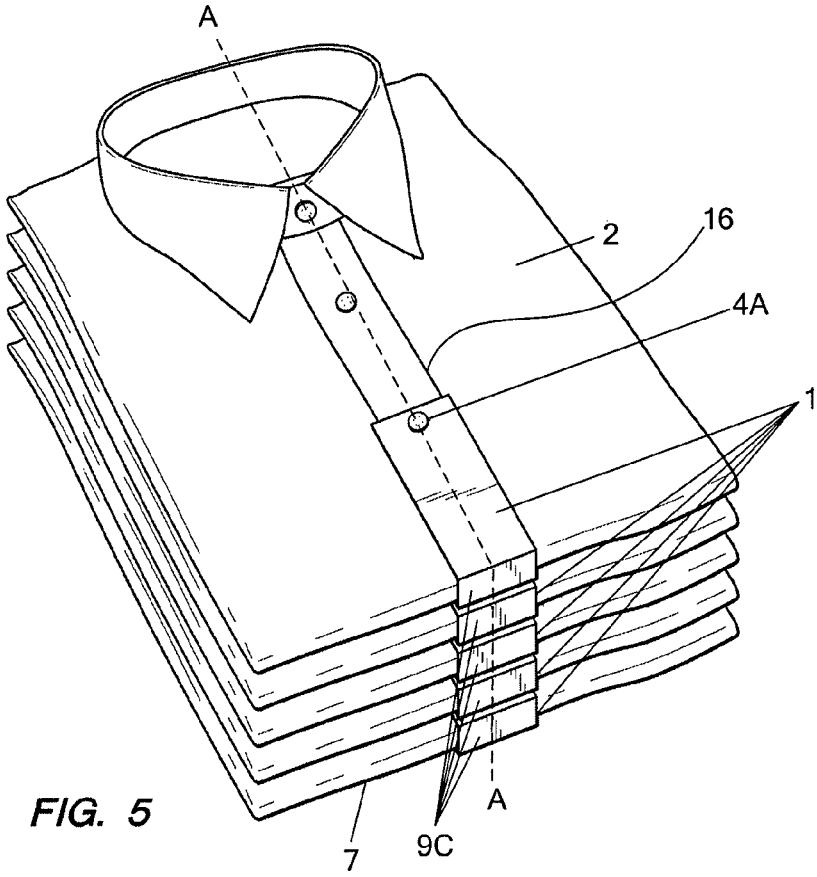
FIG. 5 shows a stack of labeled garments shown in FIGS. 1 and 2.

The garment tag 1 shown in FIGS. 1 and 2 is preferably disposed over at least a portion of the bottom side 7 of the folded shirt 2 that would otherwise be readily visible to a consumer when the labeled shirts 2 are stacked, as, for example, is shown in FIG. 5, without having to move or otherwise disturb the folded shirts 2 of the stack. Preferably, the portion 9C is disposed covering at least the placket of the folded shirt 2, such that, as shown in FIG. 5, the garment tags 1 attached to the plurality of labeled shirts are preferably aligned with each other and axis A-A. Where information, such as shirt size, is displayed on the third portions 9C, the alignment of the third portions 9C can facilitate readily identifying and selecting a particular shirt size by disposing the sizing information in one continuous column.

The first and second attachment means, proximate to the corresponding first and second ends, 10 and 11, respectively, are preferably configured to attach to the corresponding first and second buttons, and more preferably, to corresponding button shanks of those buttons. As shown in FIG. 3, a first slot 14 is formed in the first end 10 and a second slot 15 is formed in the second end 11. The first slot 14 includes an entrant region 14A suitably dimensioned to permit at least the first button shank to be drawn therein. The second slot 15 includes an entrant region 15A suitably dimensioned to permit at least the second button shank to be drawn therein. In addition, the entrant regions 14A and 15A can also be configured to permit entry of the respective first and second buttons, 4A and 4B, therethrough. Each of the entrant regions 14A and 15A extend longitudinally inwardly fixed distances, which may be different, and may be dependent upon the sizes of the corresponding buttons which can pass therethrough. The first slot 14 terminates at an enlarged aperture 14B formed in the band 9. The enlarged aperture 14B is configured to accommodate and retain the first button shank. The second slot 15 terminates at an enlarged aperture 15B formed in the band 9. The enlarged aperture 15B is configured to accommodate and retain the second button shank once past the entrant region 15A. Each of the enlarged apertures 14B, 15B, may be formed as a circle, oval, square, or other curvilinear or polygonal shape sufficient to accommodate the respective first and second button shanks disposed therein. The width of the entrant portions 14A, 15A, may be less than the width of the corresponding button shanks drawn therein, such that there is some frictional resistance between the interior edges of the slots 14 and 15 and the corresponding button shanks. Moreover, the enlarged apertures 14B and 15B can have a width that is at least the width of the corresponding button shanks disposed therein. By virtue of this arrangement, the entrant regions 14A, 15A, and the enlarged apertures 14B, 15B, provide a positive closure and retention of the corresponding button shanks in the enlarged apertures 14B, 15B, when each corresponding button shank is passed through the corresponding entrant regions 14A and 15A and into the enlarged apertures 14B and 15B.

The garment tag 1 described above, may be attached to the folded shirt 2 by inserting the first and second buttons 4A and 4B into the respective first and second slots 14 and 15, such that the button shank of each corresponding button is disposed in the entrant regions 14A and 15A thereof, and translating the button shanks toward and into the corresponding enlarged apertures 14B and 15B from the entrant regions 14A and 15A. The garment tag 1 can be retained on the button shanks by the enlarged apertures 14B and 15B at least until a sale of the labeled folded shirt 2 to the consumer, after which the consumer may detach the garment tag 1 prior to using the garment at least by reversing the steps of attaching the garment tag 1 described above.

Various modifications of the embodiments of the garment tag 1 are possible. For example, it will be appreciated that the band 9 may, in alternative embodiments, be arranged to extend around and at least partially cover one or more other sides or folds of the shirt without departing from the scope of the invention. For example, the garment tag may be configured to extend around the top side 6 of the folded shirt 2 so as to wrap around the collar of the shirt 2. Such an embodiment may be useful for displaying indicia on an outer surface of a portion of the garment tag covering the top side 6 proximate to the collar in a case where the labeled shirts are displayed with the top side 6 of the folded shirt 2 viewable by the consumer in a stack of labeled shirts, such as when the shirts are alternately stacked as described earlier. Moreover, while the band 9 has been shown as extending substantially parallel to axis A-A, in at least one alternative embodiment, the band 9 may be configured to extend at an angle with respect to the longitudinal axis A-A. Modifications of the first and second slots 14 and 15 of the band 9 are also possible. For example, in at least one alternate embodiment, the slots 14 and 15 may be configured to omit the enlarged apertures, 14B and 15B, at the end of the respective slots 14 and 15. In such an embodiment, friction between the button shank and the slot, as well as friction between one of the buttons 4A and 4B, the garment tag 1, and the folded shirt 2, facilitate retaining the garment tag 1 in the first and second slots 14 and 15, respectively.

Figure 4:
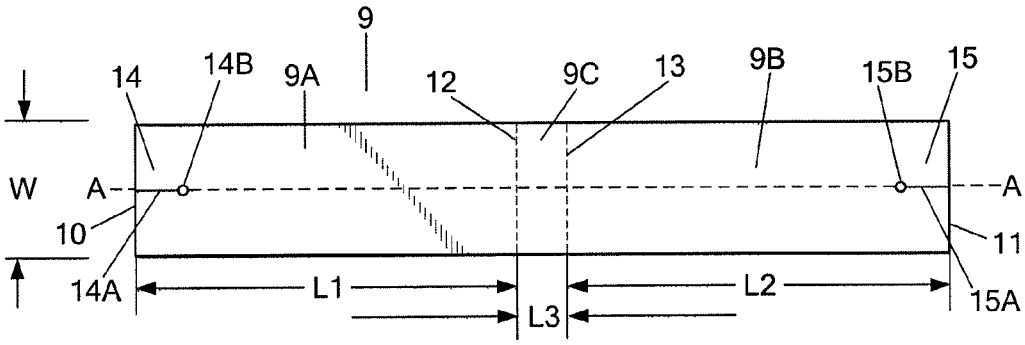
FIG. 4 shows a plan view of an alternate embodiment of the garment tag shown in FIGS. 1-3.

Another embodiment of the garment tag is shown in FIG. 4, where, unlike the slots 14 and 15 shown in FIG. 3, the respective entrant regions 14A, 15A, of the slots extend completely to respective outer edges 10 and 11 of the band 9. Where the regions of the band 9 bordering the slots 14 and 15 are formed from suitably flexible and resilient material, the entrant regions 14A and 15A of those slots may be formed by forming a slit without removing any material such that the slots have negligible width. In such an embodiment the width of the slit may be enlarged by deflecting portions of the band 9 on either side of the slit relative to each other. By virtue of such an arrangement, the portions on either side of the slit can be deflected a sufficient amount to draw the button shank therein.

Figure 6:
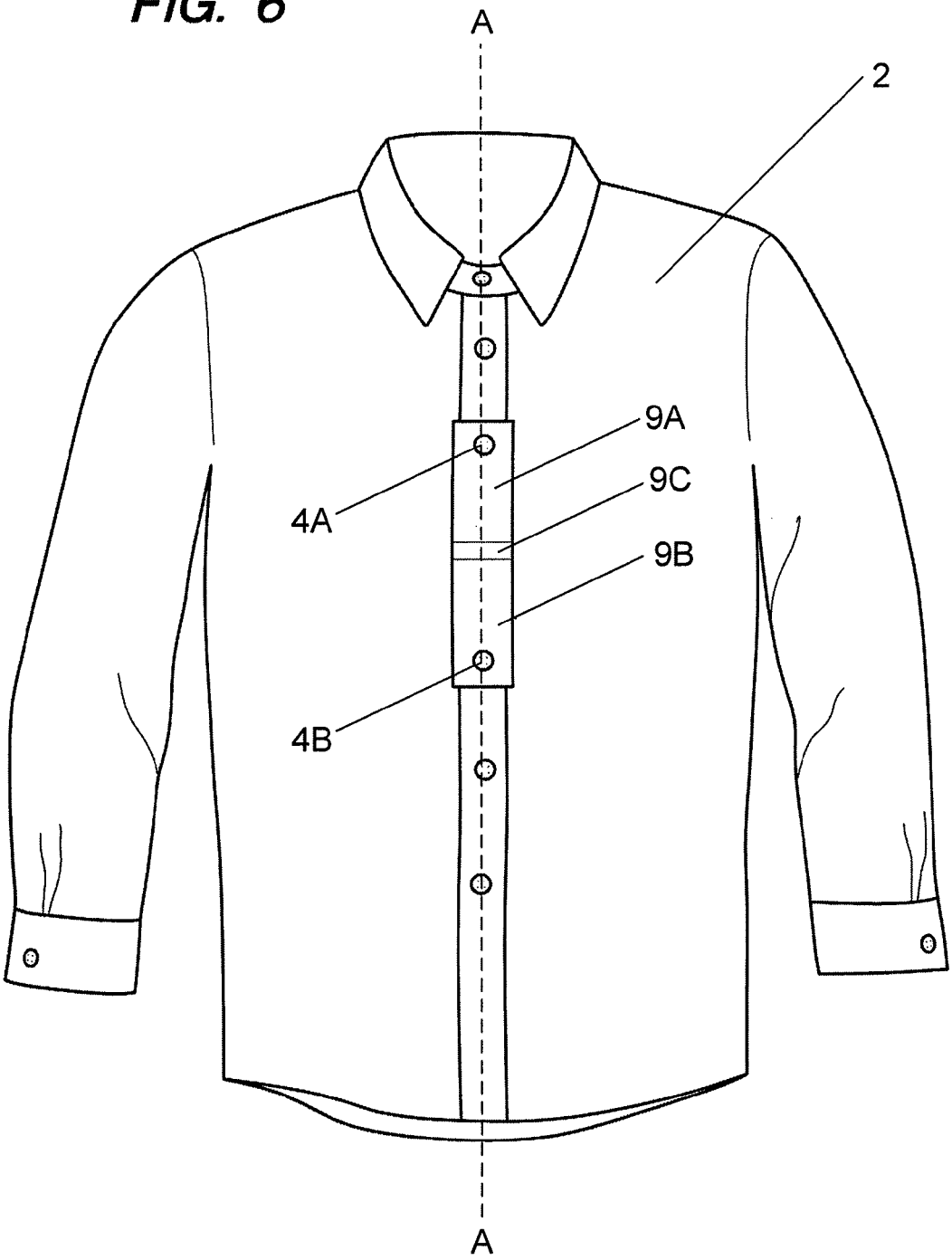
FIG. 6 shows an unfolded garment tag attached to a garment that is not folded.

While the garment tag 1 has been shown and described above as attached and presented with a folded garment (e.g., a shirt 2), in another embodiment, the garment tag 1 can be configured to be attached to an unfolded garment 2, such as an unfolded shirt shown in FIG. 6. The garment tag 1 can be connected to buttons 4A and 4B as described above when the shirt is unfolded, and by virtue of subsequently folding the shirt, the garment tag 1 can be folded or otherwise formed around the fold (bottom side 7) of the shirt 2, while remaining attached to the shirt 2. Preferably, folding the shirt 2 will dispose the third portion 9C over the fold (bottom side 7) of the shirt 2.

Figure 7:
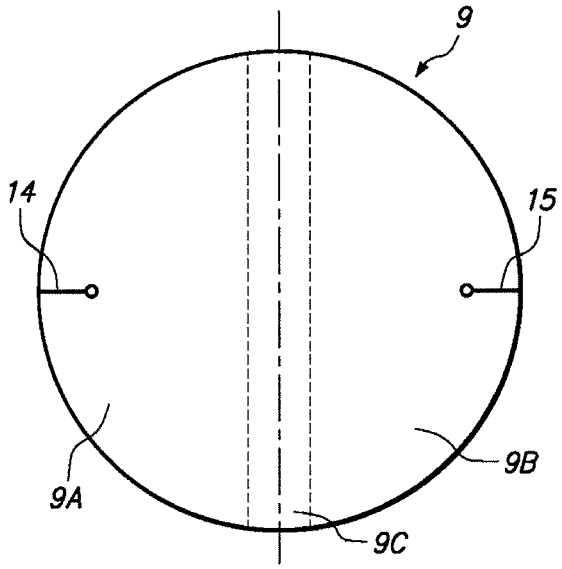
FIG. 7 shows a plan view of an alternate embodiment of the garment tag shown in FIGS. 1-6.

In another alternate embodiment shown in FIG. 7, the band 9 may also be configured to be formed substantially in a circular shape. In such an embodiment, the first portion 9A and the second portion 9B are configured to be substantially semicircular. In such an embodiment, the center of the circular band 9 is preferably at the midpoint of the band 9.

Figure 8:
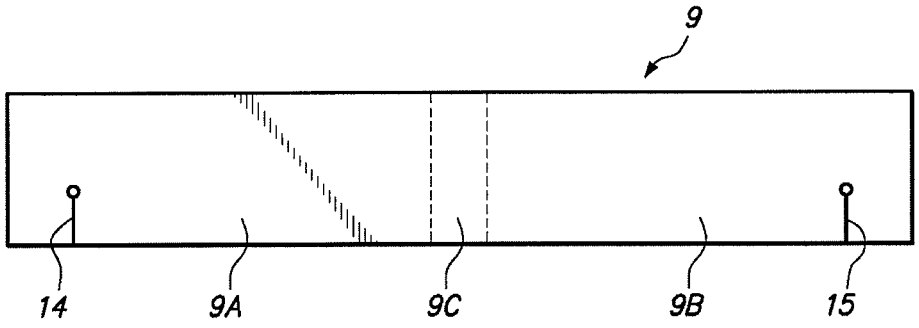
FIG. 8 shows a plan view of another embodiment of the garment tag shown in FIGS. 1-7.

An alternate embodiment of the garment tag 1 shown in FIGS. 3 and 4, is shown in FIG. 8, where the direction of the slots 14 and 15 is configured to extend at angle with respect to the longitudinal axis A-A. As shown in FIG. 8, the slots 14 and 15 extend substantially perpendicular to the longitudinal axis A-A.

While the garment tag 1 has been shown in FIGS. 1 and 2 as comprised of a band 9 formed of substantially planar portions 9A-9C, it should be noted, that in at least one other embodiment (not shown), the band 9 is not folded in planar sections 9A-9C, but is instead attached to the first and second buttons 4A and 4B and allowed to simply curve around the bottom side 7 of the folded shirt 2 so that the third portion 9C covers at least a portion of the bottom edge 7 of the folded shirt.

Moreover, while in a preferred embodiment the garment tag 1 includes openings for attaching to buttons 4A and 4B of the folded shirt 2, in alternate embodiments, the openings may also be configured to attach to other types of fasteners, including, but on limited to, various toggles, clips, hooks, snap closures, and magnetic closures. Also, the attachments may be configured to attach to connections, such as for example, thread, between such fasteners (e.g., buttons) and the folded garment 2.

Figure 9:
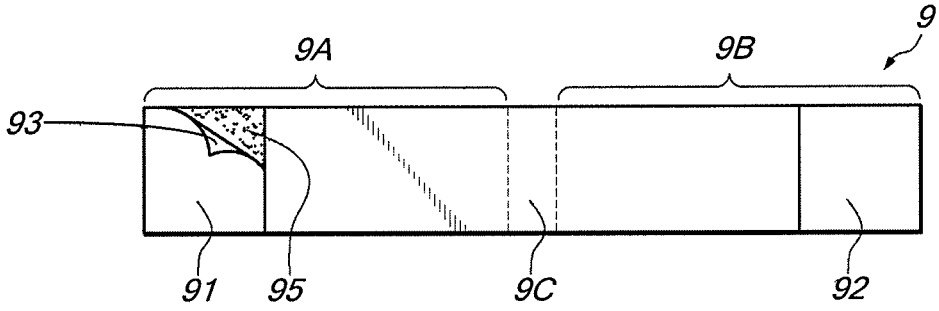
FIG. 9 shows a plan view of another embodiment of the garment tag shown in FIGS. 1-8.

In yet another embodiment shown in FIG. 9, the garment tag 1 is configured to be attached to the garment 2 with at least one of a permanent and a non-permanent adhesive. In such an embodiment, the garment tag 1 includes a band 9 having a first adhesive area 91 for attaching to a first area of the garment and a second adhesive area 92 for attaching to a second area of the garment. The adhesive may be applied to the first and second adhesive areas and covered with a removable backing 93. The backing 93 can be removed to expose the adhesive prior to attachment of the garment tag 1 to the garment 2. Also, in place of adhesive, hook and loop fasteners can be used.

Figure 10:
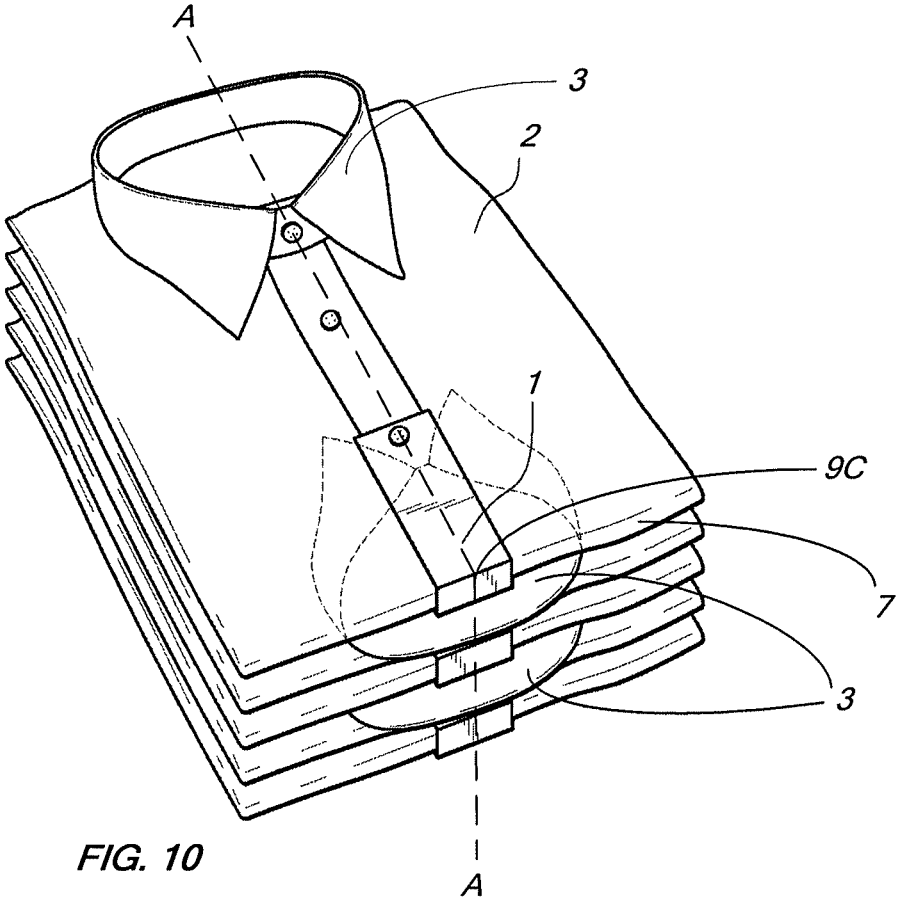
FIG. 10 shows another stack of labeled garments stacked in an alternate configuration to that shown in FIG. 5.

As shown in FIG. 10, the labeled shirts 2 may also be stacked in an alternate configuration from that shown in FIG. 5. In FIG. 10 the shirts 2 are stacked vertically as in FIG. 5 with the front side 5 of each shirt 2 facing in the same direction (e.g., upwardly). However, every other shirt 2 in the stack is disposed 180 degrees apart from adjoining shirts 2 with respect to a vertical axis through the plurality of labeled shirts 2. A consumer viewing the stack shown in FIG. 10 will therefore be presented with an aligned column of garment tags 1 attached to every other shirt 2.

While the present invention has been described with respect to what is presently considered to be the preferred embodiments, it is to be understood that the invention is not limited to the disclosed embodiments. To the contrary, the invention is intended to cover various modifications and equivalent arrangements included within the spirit and scope of the appended claims.

What is claimed is:

1. A garment tag comprising:

a band having a first opening constructed to attach to a first fastener of a garment and a second opening constructed to attach to a second fastener of the garment, wherein the first and second openings of the band are spaced apart by a fold in the band, the band having a first display portion at the fold in the band that displays information regarding the garment at a fold in the garment when the garment is in a folded state.

2. The garment tag according to claim 1, wherein the first and second fasteners are buttons.

3. The garment tag according to claim 1, wherein the first and second openings are slots.

4. The garment tag according to claim 1, wherein the first display portion is defined by two creases in the band, the creases being spaced apart by the approximate width of the garment fold.

5. The garment tag according to claim 4, wherein the band is pre-folded at the creases.

6. The garment tag according to claim 1, wherein the band is made of at least one of paper, paperboard, cardboard, plastic, woven fabric, ribbon, and card stock.

7. The garment tag according to claim 1, wherein the band is substantially rectangular in shape.

8. The garment tag according to claim 1, wherein the band is substantially circular in shape.

9. The garment tag according to claim 8, wherein a portion of the band between the first display portion and the first opening is substantially semicircular, and another portion of the band between the first display and the second opening is substantially semicircular.

10. The garment tag according to claim 1, wherein the displayed information relates to at least one of a: fabric type, scanning bar code, garment size, brand identifier, manufacturer, garment item number, garment care information, recycling symbol, garment identifier, garment color, garment fit type, and garment style.

11. The garment tag according to claim 1, further including a radio-frequency identification (RFID) chip.

12. The garment tag according to claim 1, wherein the band openings are constructed to be attached to the fasteners when the garment is in an unfolded state, and wherein the garment is subsequently folded.

13. The garment tag according to claim 1, wherein the band openings are constructed to be attached to the fasteners subsequent to the garment being folded.

14. The garment tag according to claim 4, wherein the band has a second display portion that displays information regarding the garment located between the first opening and the first display portion.

15. The garment tag according to claim 14, wherein the band has a third display portion that displays information regarding the garment located between the second opening and the first display portion.

16. The garment tag according to claim 15, wherein the first and second openings are positioned proximate to a longitudinal centerline of the band extending through the first, second, and third display portions.

17. The garment tag according to claim 16, wherein the first and second openings are positioned at proximal and distal ends of the band.

18. The garment tag according to claim 17, wherein the first and second openings are slots constructed to extend in at least one of the following directions: substantially parallel to the longitudinal centerline, and substantially perpendicular to the longitudinal centerline.

19. The garment tag according to claim 17, wherein the first display portion is positioned approximately midway between proximal and distal ends of the band.

20. The garment tag according to claim 19, wherein the garment includes at least one of a shirt, a dress shirt, pants, trousers, shorts, sweater, sweatshirt, jacket, and coat.

21. The garment tag according to claim 3, wherein each of the slots include, at an inner end thereof, an aperture having a width larger than the width of the corresponding slot.

22. The garment tag according to claim 21, wherein the first fastener is a first button and the second fastener is a second button, and wherein each of the apertures is constructed to receive a corresponding button shank connecting the first and second buttons to a shirt.

23. A garment tag comprising:

a band having a first fastener for attaching into a first opening of a garment and a second fastener constructed to attach into a second opening of the garment, wherein the first and second fasteners of the band are spaced apart by a fold in the band, the band having a display portion at the fold in the band that displays information regarding the garment at a fold in the garment when the garment is in a folded state.

24. A garment tag comprising:

a band having a first adhesive area constructed to attach to a first area of a garment and a second adhesive area constructed to attach to a second area of the garment, the band having a display portion that displays information regarding the garment on a first side of the band at a fold in the garment when the garment is in a folded state, wherein the first adhesive area and the second adhesive area are spaced apart by a non-adhesive area on a second side of the band opposite to the first side, wherein the band includes a first crease and a second crease spaced apart by the display portion that displays information regarding the garment.

25. The garment tag according to claim 24, wherein the first adhesive area and the second adhesive area include at least one of a permanent adhesive and a non-permanent adhesive.

26. The garment tag according to claim 25, wherein the first adhesive area and the second adhesive area include a removable backing that can be removed to expose the adhesive.

27. The garment tag according to claim 1, wherein the first opening is formed by a first loop attached to the band and the second opening is formed by a second loop attached to the band.

28. The garment tag according to claim 27, wherein at least one of the first loop and the second loop are elastic.

29. A tagged garment comprising:

a garment having a first fastener and a second fastener; and a band having a first opening attached to the first fastener of the garment and a second opening attached to the second fastener of the garment, wherein the first and second openings of the band are spaced apart by a fold in the band, the band having a first display portion at the fold in the band that displays information regarding the garment at a fold in the garment when the garment is in a folded state.

30. A plurality of tagged garments arranged in a stack, each garment having a first fastener and a second fastener; and a band having a first opening attached to the first fastener of the garment and a second opening attached to the second fastener of the garment, wherein the first and second openings of the band are spaced apart by a fold in the band, the band having a first display portion at the fold in the band that displays information regarding the garment at a fold in the garment when the garment is in a folded state.

31. A method of making a garment tag, comprising the steps of:

making a band;

forming a first opening at a proximal end of the band;

forming a second opening at a distal end of the band;

creating two creases in the band, the creases spaced apart by the approximate width of a garment when the garment is in a folded state;

displaying information on a display portion of the band, the display portion of the band located between the two creases.

32. A method of applying a garment tag to a garment, the garment tag comprising a band having first and second openings respectively positioned at proximal and distal ends of the band, wherein the first and second openings of the band are spaced apart by a fold in the band, the band further having a first display portion at the fold in the band that displays information regarding the garment at a fold in the garment when the garment is in a folded state, comprising the steps of:

attaching the first opening to a first fastener of the garment; and attaching the second opening to a second fastener of the garment.

33. The method according to claim 32, further comprising the step of folding the garment so that the display portion of the garment tag folds over the fold in the garment.

34. The method according to claim 32, further comprising the step of folding the garment so that the display portion of the garment tag covers at least a portion of the fold in the garment.

35. The method according to claim 33, further comprising the step of stacking two or more folded garments, each garment have a garment tag applied thereto.

36. The garment tag according to claim 1, wherein the first opening of the band and the second opening of the band are spaced apart by the first display portion to permit attachment of the first opening of the band to the first fastener of the garment and to permit attachment of the second opening of the band to the second fastener of the garment.

37. The garment tag according to claim 23, wherein the first fastener of the band and the second fastener of the band are spaced apart by the first display portion to permit attachment of the first fastener of the band to the first opening of the garment and to permit attachment of the second fastener of the band to the second opening of the garment.

38. The tagged garment according to claim 29, wherein the first opening of the band and the second opening of the band are spaced apart by the first display portion to permit attachment of the first opening of the band to the first fastener of the garment and to permit attachment of the second opening of the band to the second fastener of the garment.

39. The plurality of tagged garments according to claim 30, wherein the first opening of the band and the second opening of the band are spaced apart by the first display portion to permit attachment of the first opening of the band to the first fastener of the garment and to permit attachment of the second opening of the band to the second fastener of the garment.

40. The method according to claim 31, wherein creating the two creases includes creating the two creases between the first opening of the band and the second opening of the band, and wherein displaying information on the display portion includes displaying information between the two creases.

41. The method according to claim 31, wherein displaying information on the display portion includes displaying information regarding the garment on the display portion, the display portion being at a fold in the garment when the garment is in a folded state.

42. The method according to claim 31, wherein forming the first opening includes forming the first opening to attach to a first fastener of the garment, and wherein forming the second opening includes forming the second opening to attach to a second fastener of the garment.

43. The method according to claim 42, wherein the first fastener of the garment and the second fastener of the garment are buttons.

44. The method according to claim 32, wherein the first opening of the band and the second opening of the band are spaced apart by the first display portion to permit attachment of the first opening of the band to the first fastener of the garment and to permit attachment of the second opening of the band to the second fastener of the garment.

45. The garment tag according to claim 1, wherein the band is folded at the fold in the garment when the garment is in the folded state.

46. The garment tag according to claim 23, wherein the band is folded at the fold in the garment when the garment is in the folded state.

47. The tagged garment according to claim 29, wherein the band is folded at the fold in the garment when the garment is in the folded state.

48. The plurality of tagged garments according to claim 30, wherein the band is folded at the fold in the garment when the garment is in the folded state.

49. The method according to claim 31, wherein the band is folded at the fold in the garment when the garment is in the folded state, wherein the first and second openings of the band are spaced apart by the fold in the band, and wherein the display portion is positioned at the fold in the band.

50. The method according to claim 32, wherein the band is folded at the fold in the garment when the garment is in the folded state.

51. A tagged garment comprising:

a garment having a first fastener and a second fastener, wherein the garment includes at least one of a shirt and a dress shirt, and wherein the first fastener is a first button and the second fastener is a second button; and a band having a first opening attached to the first fastener of the garment and a second opening attached to the second fastener of the garment, the band having a first display portion that displays information regarding the garment at a fold in the garment when the garment is in a folded state, and wherein the band is folded between the first opening of the band and the second opening of the band.

52. A tagged shirt comprising:

a folded shirt having a first button and a second button which are spaced apart across the fold in the shirt; and a band having a first opening attached to the first button and a second opening attached to the second button, the band having a display portion between the first opening and the second opening, wherein the display portion displays information associated with the shirt at the fold in the shirt and wherein the band is folded at the display portion.

53. The tagged shirt according to claim 52, wherein the shirt is a dress shirt.

* * * * *